US005085023A

United States Patent [19]

Duffy

[11] Patent Number: 5,085,023

[45] Date of Patent: Feb. 4, 1992

[54] INSULATION SUPPORTING MEANS FOR METAL BUILDINGS

[76] Inventor: Clifford D. Duffy, P.O. Box 42, The Dalles, Oreg. 97058

[21] Appl. No.: 645,705

[22] Filed: Jan. 25, 1991

[51] Int. Cl.[5] ..... F04B 1/74; F04B 7/00

[52] U.S. Cl. ..... 52/410; 52/90; 52/404; 52/407

[58] Field of Search ..... 52/410, 404, 407, 90, 52/713, 714

[56] References Cited

U.S. PATENT DOCUMENTS

| | | | |
|---|---|---|---|
| 3,969,863 | 7/1976 | Alderman | 52/407 |
| 4,069,636 | 1/1978 | Kessler | 52/407 |
| 4,117,641 | 10/1978 | Wells | 52/404 |
| 4,251,972 | 2/1981 | Interplante | 52/404 |
| 4,266,384 | 5/1981 | Orals et al. | 52/410 |
| 4,333,292 | 6/1982 | Musgrave | 52/410 |
| 4,391,075 | 7/1983 | Musgrave | 52/404 |
| 4,724,651 | 2/1988 | Fligg | 52/407 |

*Primary Examiner*—Michael Safavi
*Attorney, Agent, or Firm*—Eugene M. Eckelman

[57] ABSTRACT

A plurality of support strips are suspended from metal building purlins by a hook tab. This hook tab forms a part of a first one of the strip sections and is held down in locking engagement on the purlin by the telescoping engagement of another section onto the first section. Spacer strips may be employed longitudinally of the building for selectively spacing the support strips.

4 Claims, 2 Drawing Sheets

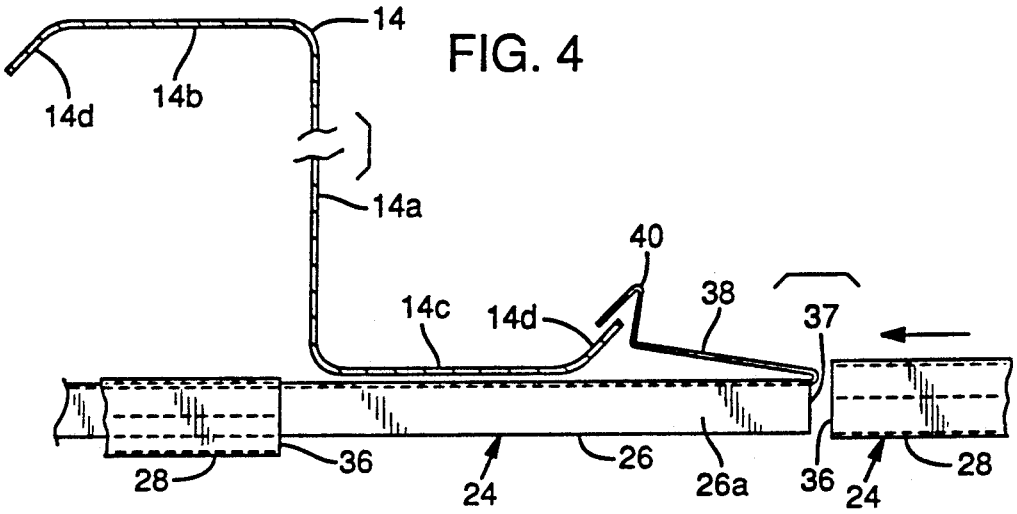
FIG. 4
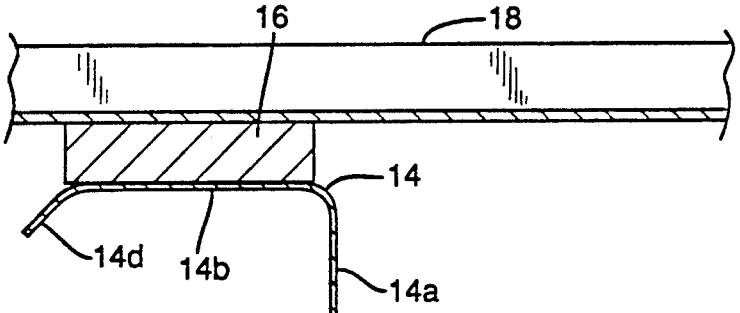
FIG. 5
FIG. 6
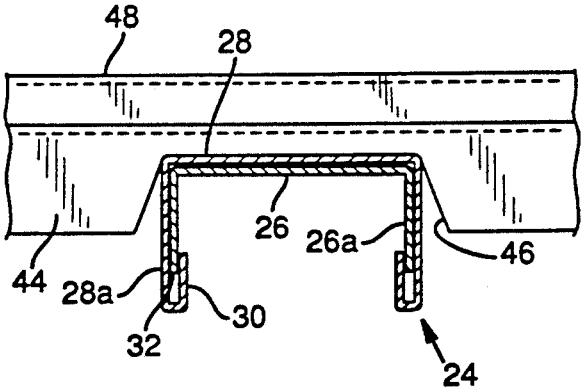
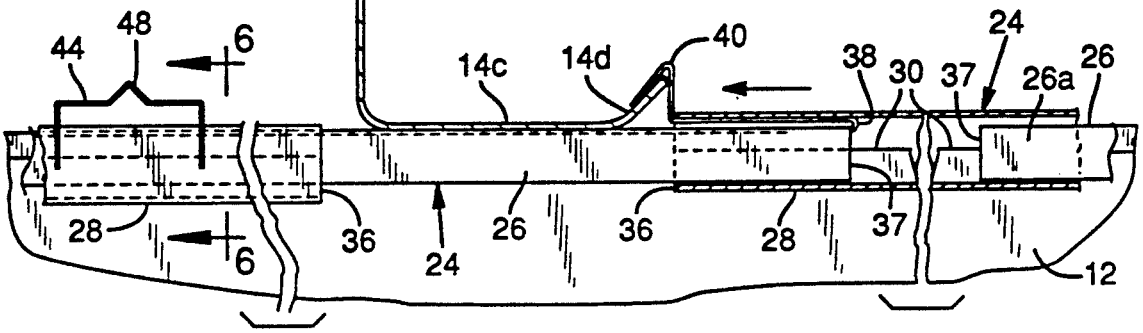

INSULATION SUPPORTING MEANS FOR METAL BUILDINGS

BACKGROUND OF THE INVENTION

This invention relates to a new and useful insulation support means for metal buildings.

In the construction of metal buildings, rigid frames are spaced along the length of the building and have ground supported uprights with lateral rafter portions. Longitudinally extending Z-shaped purlins are secured on the top of these rigid frames for roof support and have sufficient vertical dimension that provides an area for insulation between them. Since there is considerable spacing between the rigid uprights and between the purlins, some type of support is necessary to hold the insulation under the roof covering. Prior insulation supports have been complex constructed frames or baskets that are hung in place. With the use of constructed frames, there is the disadvantage that they are expensive as well as difficult and time consuming to install. The basket-type supports have the disadvantage that they have to be specially manufactured to fit purlin spacing and are expensive.

SUMMARY OF THE INVENTION

According to the invention and forming a primary objective thereof, an improved structure is provided for holding roof insulation on metal buildings of the type that utilize top Z-shaped purlins as a part of the frame construction.

More particular objects are to provide insulation holding means that is designed for quick attachment to existing purlins of the building, that includes its own attaching means with little or no fasteners, and that is inexpensive in its construction and easy to install.

In carrying out the objectives of the invention, the insulation supporting means includes a plurality of strips that extend laterally of the building in spaced relation for providing a bed frame to support insulation. The strips have hanger means thereon which are engageable with turned up edges of a base leg of the purlins to provide a suspended support attachment of the strips on the purlins. The hanger means includes self-contained locking structure on the strips for fixed attachment to the purlins.

The invention will be better understood and additional objectives and advantages will become apparent from the following description taken in connection with the accompanying drawings.

BRIEF DESCRIPTION OF THE DRAWINGS

FIG. 4 is a fragmentary, foreshortened sectional view taken through a purlin and showing the present support means in a step of installing it on the building;

FIG. 5 is a view taken similar to FIG. 4 but showing an attached position of the support means on the building; and FIG. 6 is an enlarged fragmentary sectional view taken on the line 6—6 of FIG. 5.

DETAILED DESCRIPTION OF A PREFERRED EMBODIMENT

Figure 1:
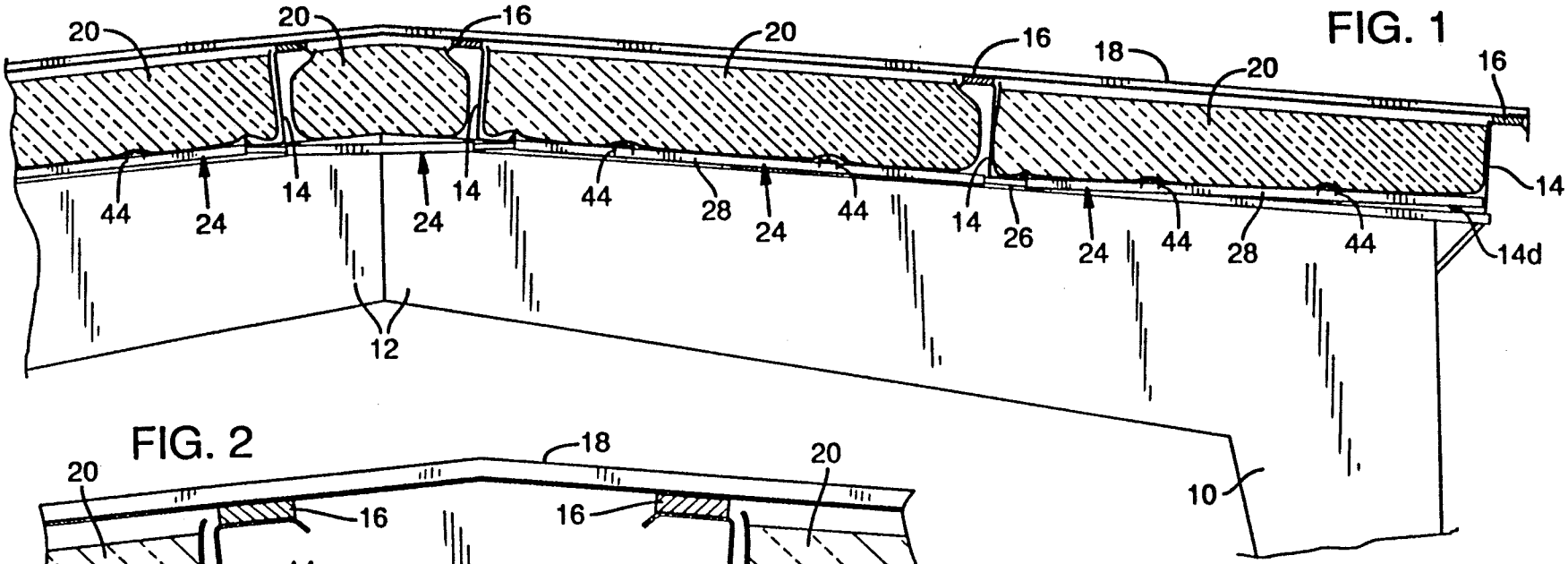
FIG. 1 is a fragmentary sectional view taken laterally through a metal type building and showing the present insulation support installed therein.

With reference to the drawings, the present insulating supporting means is used with metal type buildings that have ground supported uprights 10, FIG. 1, with lateral rafter portions 12. These uprights support longitudinal Z-shaped purlins 14 on the top thereof which conventionally comprise an upright body portion 14*a*, FIGS. 4 and 5, a top horizontal flange 14*b* leading from the body portion at a right angle, and a horizontal base flange 14*c* also leading from the body portion at a right angle but in a direction opposite from flange 14*b*. The flanges 14*b* and 14*c* terminate in an angular free edge 14*d* turned back about 45 degrees toward the body portion 14*a*.

The purlins are secured longitudinally along the top of the rafters 12 and support thermal blocks 16 and roof structure 18. Insulation 20, usually supplied in rolls, is laid in the area between the purlins and requires some type of support in these spaces. The present invention comprises a structure that makes it easy to install and support insulation in this area, that is inexpensive in its overall cost, and that is efficient in its support of the insulation.

The insulation support of the present invention comprises a plurality of strips 24 that extend laterally of the building in the areas between and parallel with the rafters 12 and have self-contained attaching suspended support from the purlins, as follows. These strips are constructed of first or male sections 26 having telescoping engagement with second or female sections 28. Both of the sections 26 and 28 have a channel shape, the first section 26 having interfitted slidable engagement within the second section 28, best seen in FIG. 6. More particularly the sections 28 have reverse inwardly turned free edge portions 30 on their side walls 28*a* and these edge portions receive and confine edge portions 32 of the side walls 26*a* of section 26 to form the slidable but attached connection. The free edges of portions 32 are shorter than the depth of their respective recesses formed by the reversely turned portions 30 and thus in addition to having a telescoping movement, the sections 26 and 28 have a small vertical relative movement.

Figure 3:
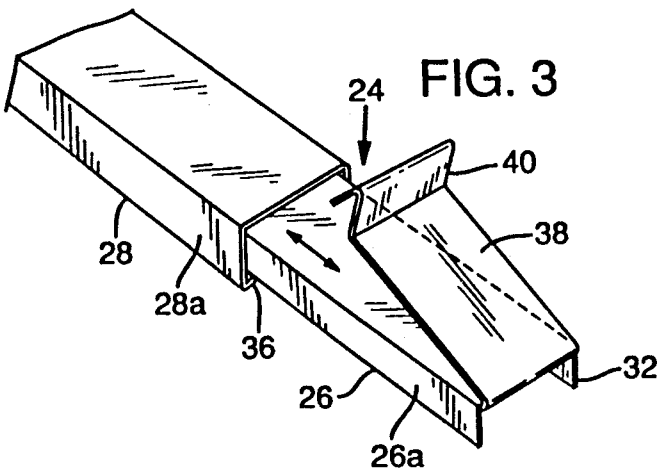
FIG. 3 is a fragmentary perspective detail view of a pair of telescoping sections of the strip that forms a part of the invention.
Figure 2:
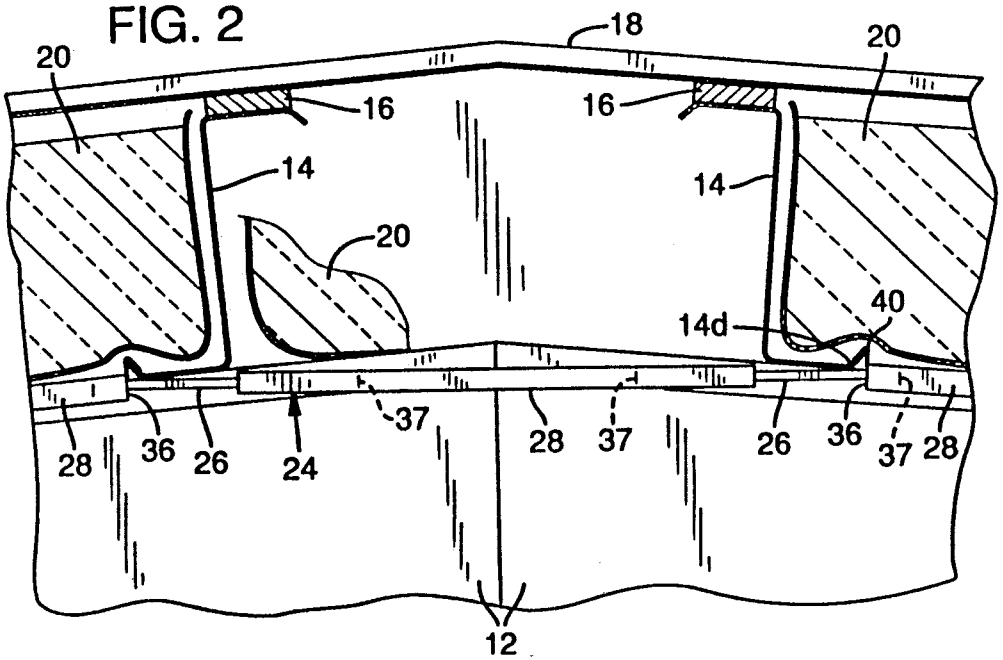
FIG. 2 is an enlarged fragmentary sectional view taken similar to FIG. 1 and showing the structure of the insulation support at the center of the building.

Second sections 28 have identical opposite open end portions 36. First sections 26 also have open end portions 37 but one of their open ends includes a turned back locking tab 38 thereon, best seen in FIG. 3. This tab comprises an extension of the main body of this channel-shaped section. The locking tab has a hook-shaped free end 40 that opens downwardly and is contoured to fit over the angular free end 14*d* of the purlin base flange 14*c*. The confinement of the wall portions 26*a* of section 26 in the portions 30 of the sections 28 allows the mentioned vertical relative movement of the sections whereby the section 28 can slide onto the end section 26 over the tab 38. This movement over the tab forces the hook shaped end 40 down in locking engagement with base flange angled portion 14*d*. FIG. 4 shows an assembly of the parts wherein the section 28 is in readiness to engage section 26 and FIG. 5 shows an engaged position causing the tab 38 to be moved into locked position on the purlin flange portion 14*d*.

The sections 26 and 28 are of selected length relative to each other such that their telescoping engagement is in an amount that provides a rigid vertical support at their overlapping portions and provides the necessary adjustment to accommodate the actuated locking connection of the tab 38 on the edge 14*d* of the purlin. These sections adjust 4 to 5 feet for purlin spacing. The ridge sections adjust 18 to 24 inches. Special sizes for all the sections can be supplied. The sections 26 at the sides of the building may be manufactured without the tab 38.

To further detail one method of installation of the strips first sections 28 and 26 are started at the ridge with central sections 28 and 26 being shortened to accommodate the narrow spacing of the purlins at the ridge. Installation proceeds outward wherein selected lengths of the first sections 28 terminate just short of the edges 14*d* of the purlins and the tab ends of sections 26 are positioned selectively and inserted into the ends of sections 28 so that the tab extensions 38 will be clamped down on the edges 14*d* of the purlins. FIGS. 4 and 5 show this clamping procedure. The end of the outer section may simply lie on the turned up edge 14*d* of the first or outside purlin, as shown in FIG. 1. If necessary, a section 26 can be inserted in this outer end for reaching the purlin. Many buildings of this type have similar purlin spacing whereby standard lengths of the sections 26 and 28 with their telescoping engagement can adjust to most installations. Sections can be readily cut if necessary since they preferably are formed of sheet metal and thus easily cut.

The strips 24 are mounted in selected parallel spacing along the building such as every two feet or less to provide a good base support for the insulation. The strips are easily mounted in place without fasteners and can be readily applied from inside the building. If desired, longitudinally extending spacing members 44 can be used to evenly space the strips 24 along the building. These members comprise inverted channel-shape strips with notches 46 selectively placed in the bottom edges thereof that fit over the top of sections 28 and hold them in spaced relation. The top wall of these spacers has a longitudinal reinforcing rib 48. In their mounted position, spacers 44 merely lie freely on the sections 48 without fasteners for quick installation, although they may have an end connection to the building and end connection to each other.

It is to be understood that the form of my invention herein shown and described are to be taken as a preferred example of the same and that various changes in the shape, size and arrangement of parts may be resorted to without departing from the spirit of my invention, or the scope of the subjoined claims.

Having thus described my invention, I claim:

1. Insulation supporting means for a building of the type using longitudinal purlins supported on uprights with lateral roof rafters, the purlins having a Z-shape in cross section with a base leg of the Z having a turned up free edge, said insulation supporting means comprising:

a plurality of support strips extending laterally in spaced relation and spaced selectively for providing a bed frame for insulation, and locking structure on said support strips providing a locked suspended attachment of said strips on the turned up free edges of the purlins, said support strips comprising a pair of telescoping members providing adjustment in length for fitting to a purlin.

2. The insulation supporting means of claim 1 wherein said support strips comprise first and second telescoping members, said first member having an end hook-like tab arranged to be locked down on the turned up free edge of the purlins by telescoping engagement by said second member.

3. The insulation supporting means of claim 1 wherein said support strips comprise first and second telescoping members, said first member having an end hook-like tab consisting of a reversely turned portion and a forwardly turned portion leading from said reversely turned portion and terminating at its free end in said hook-like tab that is pressed down in locking engagement on the turned up free edge of the purlin by telescoping engagement with said second member.

4. Insulation supporting means for a building of the type using uprights with lateral and longitudinal frame members, said insulation supporting means comprising:

a plurality of support strips extending laterally in spaced relation and spaced selectively for providing a bed surface for insulation, said support strips including first and second telescoping members, said first members having an end hook-like tab arranged to be locked on a building frame member by telescoping engagement with said second member, said end hook-like tab comprising a reversely turned portion and a forwardly turned portion leading from said reversely turned portion and terminating at its free edge in said hook-like tab that is pressed down in locking engagement to the building frame member by telescoping engagement with said second member.

* * * * *